US007066688B2

(12) United States Patent
Wallstein et al.

(10) Patent No.: US 7,066,688 B2
(45) Date of Patent: Jun. 27, 2006

(54) WEDGE BARREL FOR A TWIN CABLE MINE ROOF BOLT

(75) Inventors: Alexander I. Wallstein, Laguna Beach, CA (US); Richard Pope, Kahibah (AU)

(73) Assignee: Dywidag-Systems International USA, Bolingbrook, IL (US)

( * ) Notice: Subject to any disclaimer, the term of this patent is extended or adjusted under 35 U.S.C. 154(b) by 0 days.

(21) Appl. No.: 11/204,703

(22) Filed: Aug. 16, 2005

(65) Prior Publication Data

US 2006/0083593 A1 Apr. 20, 2006

Related U.S. Application Data

(60) Provisional application No. 60/602,192, filed on Aug. 17, 2004.

(51) Int. Cl.
*E21D 21/00* (2006.01)

(52) U.S. Cl. ..... 405/302.2; 405/288

(58) Field of Classification Search ..... 405/302.1, 405/302.2, 288
See application file for complete search history.

(56) References Cited

U.S. PATENT DOCUMENTS

| | | | | |
|---|---|---|---|---|
| 2,850,937 A | | 9/1958 | Ralston | |
| 3,650,112 A | | 3/1972 | Howlett et al. | |
| 4,140,428 A | | 2/1979 | McLain et al. | |
| 4,367,664 A | | 1/1983 | Ekshtut | |
| 4,384,812 A | | 5/1983 | Miyagawa | |
| 4,449,855 A | | 5/1984 | Langwadt | |
| 4,473,209 A | | 9/1984 | Gallis et al. | |
| 4,601,616 A | | 7/1986 | Barish et al. | |
| 4,648,753 A | | 3/1987 | Stephan | |
| 4,666,344 A | | 5/1987 | Seegmiller | |
| 4,699,547 A | | 10/1987 | Seegmiller | |
| 4,724,639 A | | 2/1988 | Moser | |
| 4,798,501 A | | 1/1989 | Spies | |
| 4,832,534 A | | 5/1989 | Duvieusart | |
| 4,884,377 A | | 12/1989 | Matt | |
| 5,219,253 A | | 6/1993 | Shinjo | |
| 5,230,589 A | | 7/1993 | Gillespie | |
| 5,238,329 A | | 8/1993 | Long et al. | |
| 5,253,960 A | * | 10/1993 | Scott | 405/302.2 |
| 5,259,703 A | | 11/1993 | Gillespie | |
| 5,797,659 A | | 8/1998 | Fuller | |
| 5,829,922 A | | 11/1998 | Calandra, Jr. et al. | |
| 5,913,641 A | | 6/1999 | Long et al. | |
| 5,919,006 A | | 7/1999 | Calandra, Jr. et al. | |
| 5,967,703 A | * | 10/1999 | Stankus et al. | 405/302.2 |
| 6,056,482 A | | 5/2000 | Calandra, Jr. et al. | |
| 6,088,985 A | | 7/2000 | Clark | |

(Continued)

FOREIGN PATENT DOCUMENTS

AT 198482 7/1958

*Primary Examiner*—Frederick L. Lagman
(74) *Attorney, Agent, or Firm*—Marshall, Gerstein & Borun LLP

(57) ABSTRACT

A twin cable mine roof bolt includes a barrel having a first end, a generally dome-shaped second end, and an outer surface, a pair of angled and narrowing bores extending through the barrel, with each bore sized to receive a cable, a pair of wedges sized for placement in each of the bores to secure the cables, and a protrusion extending from the first end of the barrel and sized for insertion into a socket wrench.

27 Claims, 4 Drawing Sheets

U.S. PATENT DOCUMENTS 6,113,060 A 9/2000 Wilde
6,293,067 B1 9/2001 Meendering
6,322,290 B1 11/2001 Calandra, Jr. et al.
6,435,778 B1 * 8/2002 Fox ..... 405/302.2
6,712,574 B1 3/2004 Roopnarine
6,722,099 B1 4/2004 Gilbert et al.
6,884,005 B1 * 4/2005 Seegmiller ..... 405/288
2003/0068214 A1 4/2003 Sommer et al.

* cited by examiner

WEDGE BARREL FOR A TWIN CABLE MINE ROOF BOLT

This application claims benefit of provisional application No. 60/602,192, filed Aug. 17, 2004.

FIELD OF THE INVENTION

The present invention relates generally to roof bolts used in underground mining operations and, more particularly, to a wedge barrel for a twin cable mine roof bolt.

BACKGROUND OF THE INVENTION

In mining operations, bolts are often used to support the roof of the mine. Typically, a hole is drilled into the rock formation that forms the mine roof, and then a mine roof bolt is placed in the hole and secured by a fast-curing resin material or other suitable substance. The roof bolt, which can be formed of wire strands woven or wound together to form a cable, includes a widened bearing plate that bears against a portion of the ceiling, thus holding a portion of the ceiling in place.

One approach for installing such bolts is to drill an over-sized hole into the rock and then insert one or more resin cartridges into the hole. The elongated cable portion of the mine roof bolt is then forced into the hole, and rotated. This process ruptures the resin cartridges and mixes the two resin components together within the space between the cable portion of the bolt structure and the over-sized hole.

Such roof bolts typically include a wedge barrel. The wedge barrel provides a bearing surface so that the tensile load carried by the elongated cable bolt can be suitably transferred to the bearing plate. The wedge barrel is commonly joined to the cable bolt by a plurality of wedges which are wedged between the cable itself and an inside tapered surface of the wedge barrel prior to installation of the roof bolt. Using a suitable tool, the wedge barrel is spun to rotate the cable within the hole as outlined above.

DETAILED DESCRIPTION OF THE PREFERRED EMBODIMENT

Figure 2:
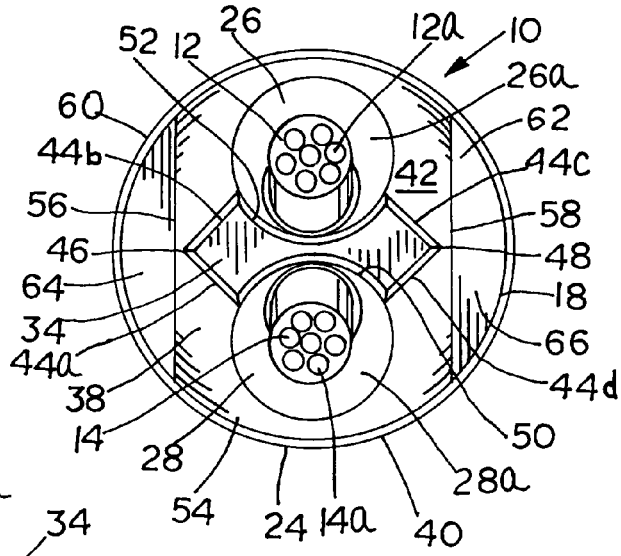
FIG. 2 is a top plan view of the wedge barrel illustrated in FIG. 1.

The example described herein is not intended to be exhaustive or to limit the scope of the invention to the precise form or forms disclosed. Rather, the following exemplary embodiment has been chosen and described in order to best explain the principles of the invention and to enable others skilled in the art to follow the teachings thereof.

Referring now to the drawings, a twin cable roof bolt assembled in accordance with the teachings of a first disclosed example of the present invention is shown and is generally referred to by the reference numeral 10. The twin cable roof bolt 10 includes a pair of cables 12 and 14, each of which is typically formed of a plurality of woven or wound wire strands as is known to those of skill in the art. For ease of reference, the positional terms that are used in the following description, such as "top" and "bottom", etc., relate to the twin cable twin cable roof bolt 10 positioned as shown in FIGS. 1–5 of the drawings. It will be understood that, when the twin cable roof bolt 10 is in use, the twin cable twin cable roof bolt 10 typically will be inverted from the position shown in FIGS. 1, 3, 4 and 5 such that the cables 12 and 14 extend upwardly into a bore hole (a portion of which is illustrated schematically in FIG. 5), which has been drilled or otherwise prepared in the ceiling of a mine.

Figure 1:
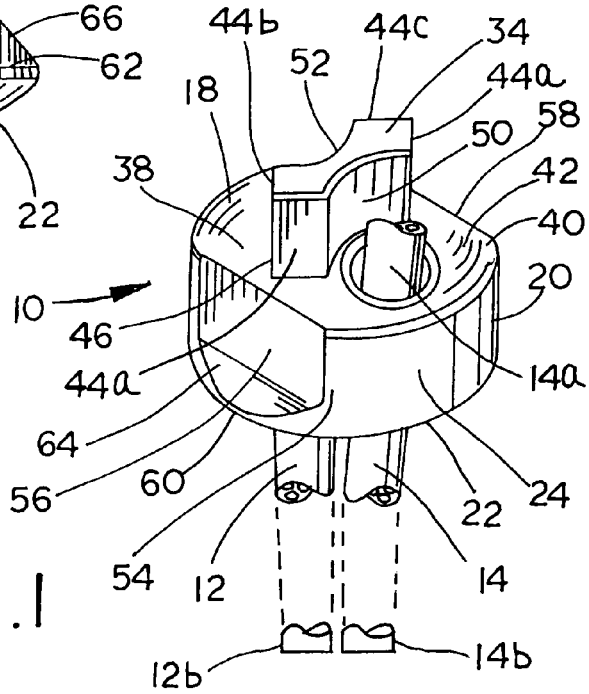
FIG. 1 is a perspective view of a wedge barrel for a twin cable roof bolt assembled in accordance with the teachings of a first disclosed example of the present invention.
Figure 6:
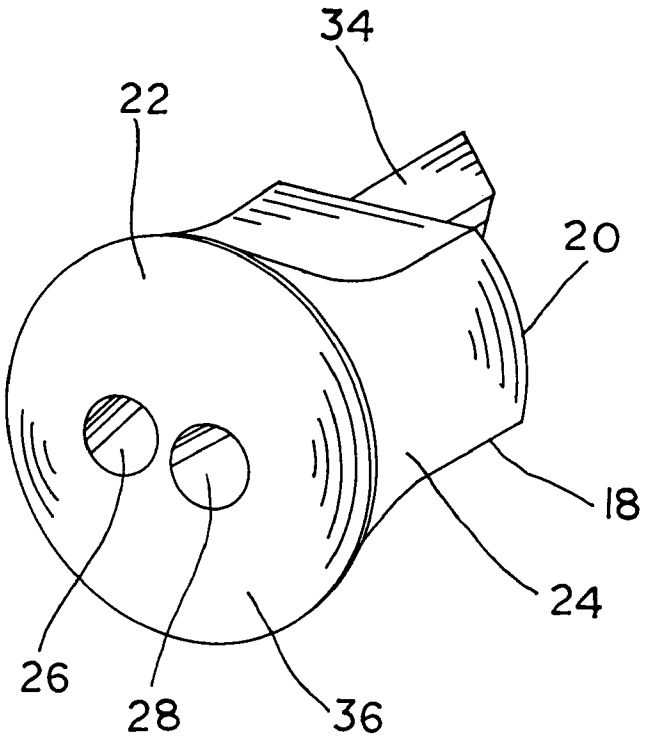
FIG. 6 is a bottom view in perspective of the wedge barrel illustrated in FIG. 1.
Figure 4:
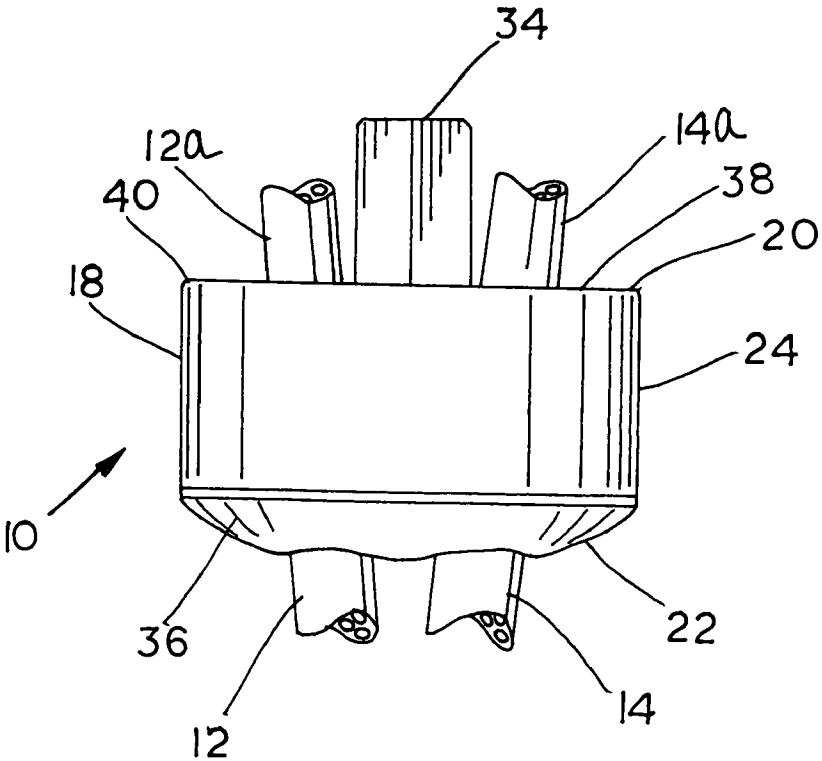
FIG. 4 is an elevational view taken along line 4—4 of FIG. 2.
Figure 5:
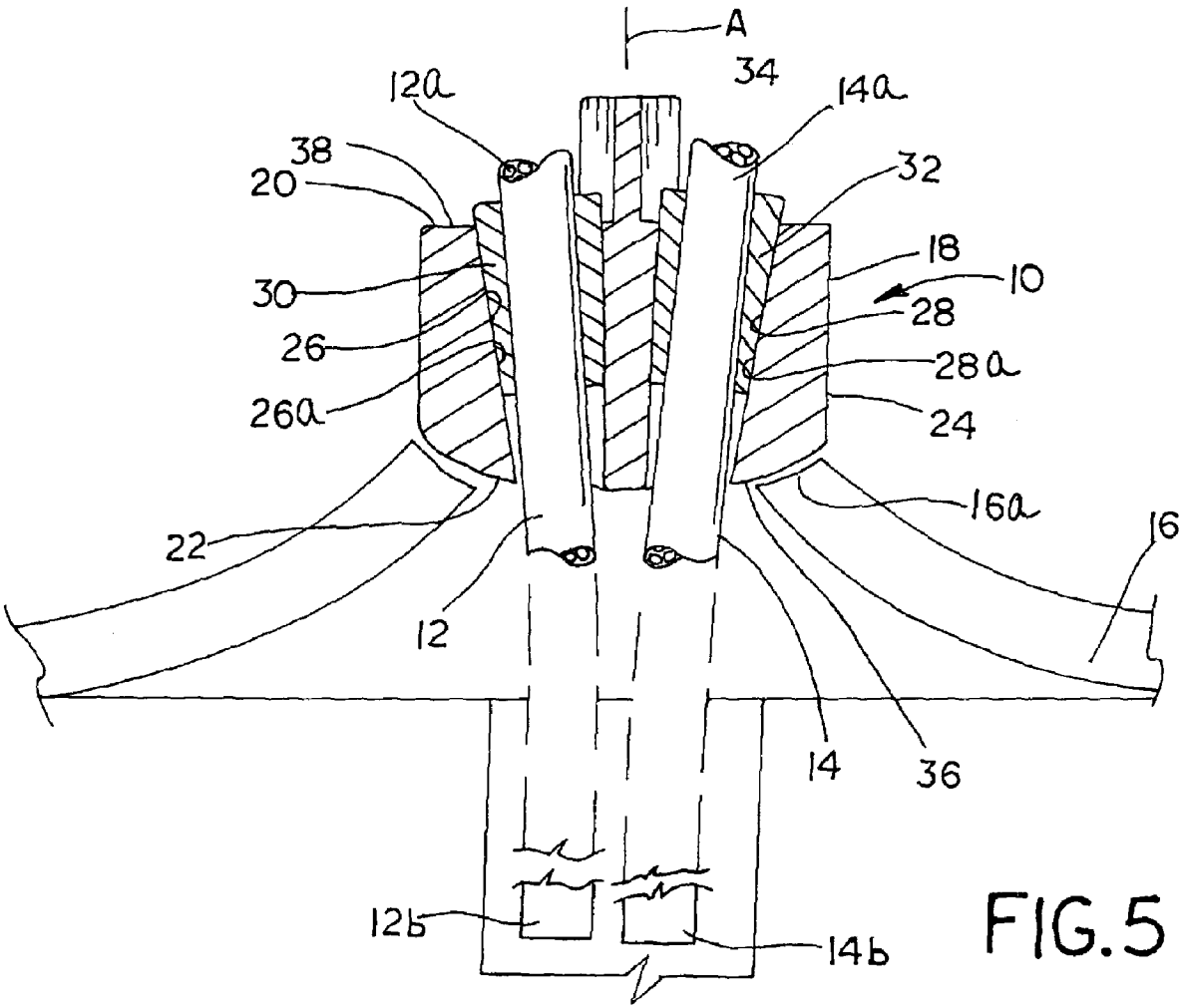
FIG. 5 is a cross-sectional view taken along line 5—5 of FIG. 2 and showing the wedge barrel in contact with a bearing plate.

The cables 12 and 14 each include a first end 12*a*, 14*a*, respectively, and a second end 12*b*, 14*b*, respectively. It will be understood that the second ends 12*b*, 14*b* are inserted into the hole in the mine roof (as shown in FIGS. 1 and 5). It also will be understood that at least a portion of each of the cables will be secured within the mine roof hole using a suitable bonding agent such as, by way of example rather than limitation, fast-curing resins, epoxies, glues, chemical bonding agents, cements, or other suitable materials as are commonly employed in the art. The twin cable roof bolt 10 typically is used in conjunction with a bearing plate 16 (shown only partially in FIG. 5) having an aperture 16*a*. As would be known, the bearing plate 16 is positioned against the roof of the mine, and the cables 12 and 14 are positioned through the aperture 16*a*.

Figure 7:
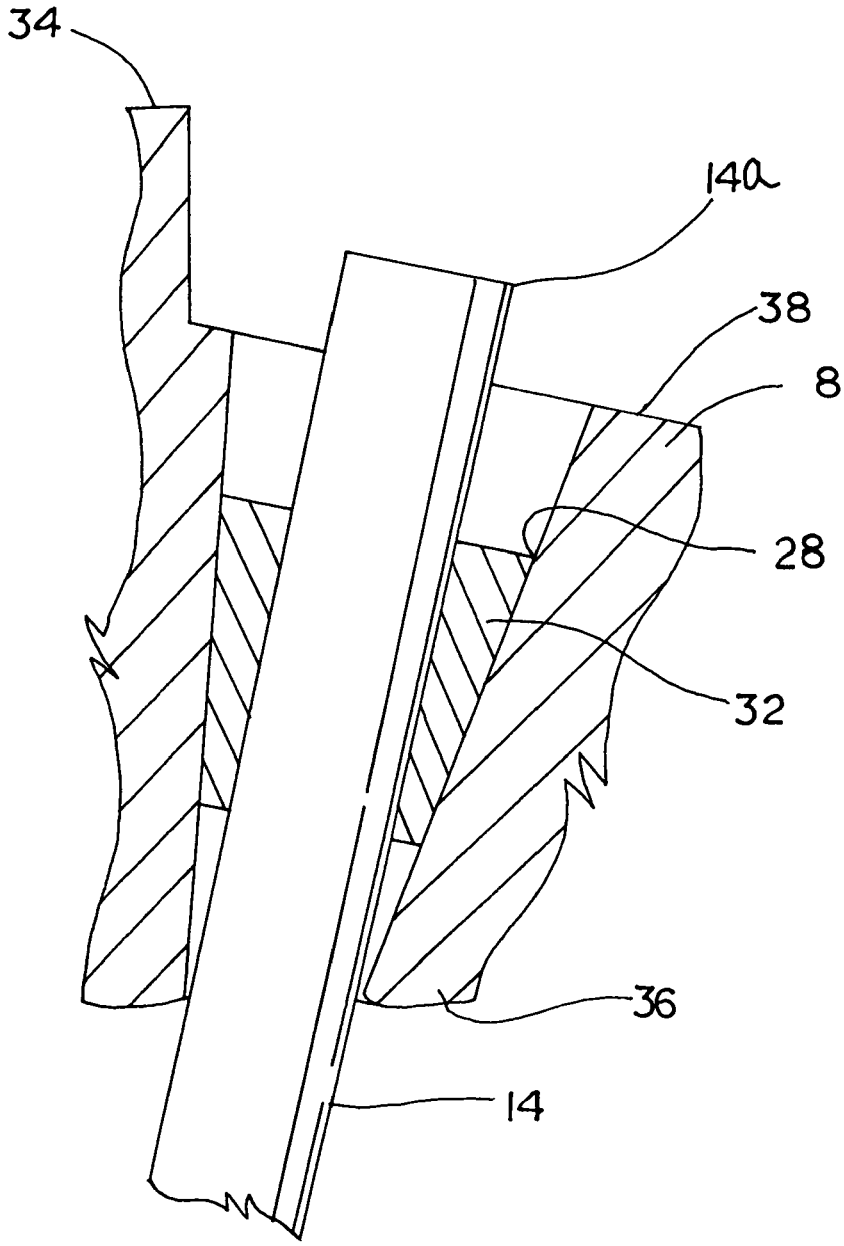
FIG. 7 is an enlarged fragmentary elevational view illustrating a driving head being positioned to engage the wedge barrel.

The twin cable roof bolt 10 includes a barrel 18 having a first or top end 20, a second or bottom end 22, and an outer surface 24. The barrel 18 defines a longitudinal axis A (FIGS. 3 and 5) which, in the preferred form of use, extends generally coaxially with the hole in the mine roof. In the preferred embodiment, it will be appreciated that the barrel 18 is generally cylindrical such that the outer surface 24 is predominantly curved. Other forms for the barrel 18 may prove suitable. A pair of bores 26, 28 extend through the barrel 18, with each of the cables 12, 14 sized for insertion into a corresponding one of the bores 26, 28, respectively. For example, the cable 12 is shown disposed in the bore 26, while the cable 14 is shown disposed in the bore 28. Each of the bores 26, 28 includes a tapered portion 26*a*, 28*a*, respectively (best visible in FIGS. 2 and 5), which may be generally conical as is commonly employed in the art. A first pair of wedges 30 is disposed in the bore 26, while a second pair of wedges 32 is disposed in the bore 28. The wedges 30 and 32 are best visible in FIGS. 5 and 7, and are omitted from FIG. 1. As would be known, the first pair of wedges are arranged to grasp or otherwise engage the cable 12, while the second pair of wedges 32 are arranged to grasp or otherwise engage the cable 14. Accordingly, the pairs of wedges 30, 32 apply a progressively greater force to the corresponding cable 12, 14, respectively, due to the tapered nature of the tapered portions 26*a* and 28*a* of the bores 26 and 28 as would be known. A protrusion 34 is attached to, or otherwise formed on, the barrel 18 generally adjacent to the first end 20. The second end 22 of the barrel 18 includes a dome-shaped or curved surface 36.

The protrusion 34 is sized and shaped to be inserted into a socket wrench or drive socket of the type commonly employed in mining operations. For example, the socket wrench may include a square recess such as, by way of example: rather than limitation, a square recess having nominal dimensions of 1⅛ inch by 1⅛ inch. Accordingly, the protrusion 34 is sized to correspond to the dimensions of the chosen socket wrench. Alternatively, the protrusion 34 may be sized to engage a socket wrench having a hexagonal recess, or any other suitably shaped recess. In the embodiment shown, the protrusion 34 extends from the first and 20 of the barrel 18. Alternatively, the protrusion 34 may form the first end 20 of the barrel 18.

Preferably, the barrel 18 includes a platform 38. In the sample shown, the protrusion 34 is set back (i.e., spaced inwardly in a radial direction) from an outer surface 40 of the platform 38. In the example shown, the platform 38 is generally flat, and the upper ends of the bores 26 and 28 terminate at the platform 38.

As best shown in FIGS. 1 and 2, the protrusion 34 extends upwardly away from a top surface 42 of the platform 38. Preferably, the protrusion 34 will extend a distance sufficient to be grasped suitably by the socket wrench. For example, the protrusion 34 may be similar in height to the thickness of a conventional hexagonal steel nut. Other dimensions may be chosen. The protrusion 34 includes four drive surfaces 44*a*, 44*b*, 44*c*, and 44*d*. It will be appreciated that the surfaces 44*a* and 44*b* generally converge at a ninety (90) degree point 46, while the surfaces 44*c* and 44*d* generally converge at a ninety (90) degree point 48. The relevant angles at the points 46 and 48 correspond to the use of a square drive socket. It will be appreciated that the relevant angles would change if, for example, a hexagonal drive socket is chosen.

As shown in FIG. 2, the surface 44*a* is parallel to the surface 44*d*, while the surface 44*b* is parallel to the surface 44*c*. Preferably, to conform to the size of a conventional drive socket, the plane of the side 44*a* is spaced from the plane of the side 44*d* a distance of 1⅛ inch, while the plane of the side 44*b* is spaced from the plane of the side 44*c* a distance of 1⅛ inch. Again, other dimensions would be chosen to correspond to the sizing of the chosen drive socket. A pair of recesses 50, 52 are formed on opposite sides of the protrusion 34. In the preferred form shown, the recesses 50, 52 are curved and, preferably, correspond to the curvature of an adjacent portion of the bores 26, 28.

Figure 3:
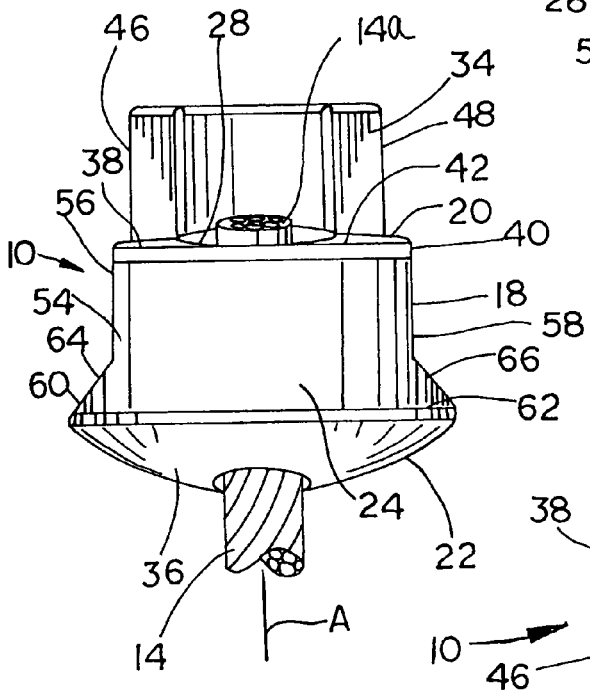
FIG. 3 is an elevational view taken along line 3—3 of FIG. 2.

Referring now to FIGS. 1–3, an intermediate portion 54 of the barrel 18 includes a pair of generally parallel flattened faces 56 and 58. In the disclosed example, the faces 56 and 58 are spaced apart a distance of about 1¾ inches. Other spacings may be chosen. As shown in FIG. 3, a lower end 60, 62 of each face 56, 58, respectively, includes a downwardly sloping flange 64, 66, respectively. In the disclosed example, the flanges are sloped approximately 45° relative to the horizontal.

Preferably, the barrel 18 and the protrusion 34 are made from cast or forged steel as a one-piece or integral unit. The bores 26, 28 may be integrally formed in the barrel 18 or, as an alternative, the bores 26, 28 may be drilled, cut, reamed, or otherwise formed using any suitable method or tools after the barrel 18 has been formed. It will be understood that the first and second pairs of wedges 30, 32 may include teeth (not shown) of the type commonly employed in wedge barrel construction, such that the teeth bite into the cable in a known manner to secure the cables within the corresponding bores.

Preferably, the outside of the barrel 18 will have a dome-shape as discussed above at the bottom or second end 22 where the second end 22 interfaces with the bearing plate 16. Thus; the second end 22 of the wedge barrel 18 meets the bearing plate 16 along a generally curved or spherical interface 19 as would be known and which, in a preferred form, serves to compensate for situations when the hole axis and the ceiling of the mine are not perpendicular. It will be understood that the bearing plate spreads out in a direction generally perpendicular relative to the axis of the cable 12 when viewing FIG. 3. It will be understood that, using a driving tool in engagement with the protrusion 34, the entire roof bolt 10 can be rotated about the axis A when the cables 12 and 14 are disposed in the prepared hole. In response to rotating the assembly as described, the cables 12 and 14 may puncture, rupture, mix, or suitably activate a resin bonding agent contained within the prepared hole to facilitate securement of the cables 12, 14 within the hole.

In accordance with the disclosed example, the protrusion 34 may avoid problems sometimes encountered when a drive nut has been glued or otherwise fixed to a conventional barrel of a prior art mine roof bolt assembly, and may also avoid problems sometimes encountered when a drive nut is fixed to an end of a single cable. These problems are avoided with the exemplary embodiment, with the added advantage that no specially-shaped drive socket is required. Instead, in accordance with the disclosed example, a standard square drive socket may be used.

Additionally, the use of two cables, with each cable preferably having one half inch diameter with an ultimate capacity of 41,000 lbs. for a total of 82,000 lbs., the present twin cable roof bolt 10 may experience a greater load carrying capacity as compared to conventional single-cable roof bolt assemblies typically employing a 0.6 in. diameter cable with an ultimate capacity of 58,600 lbs. Moreover, in accordance with the disclosed example, the two-cable, one half inch diameter configuration allows the present twin cable roof bolt 10 to be installed in a conventional 1⅜ inch diameter hole, which is the most common hole size encountered in conventional underground roof bolting operations. Further, one half inch diameter cable sizes are readily available. Consequently, in accordance with the disclosed example, most if not all of the above-described components are very economical and are, or may be, produced in commercial quantities and, in fact, a one half inch diameter cable is easier to get galvanized than is a 6/10 of an inch diameter cable, affording a higher corrosion resistance at a lower cost to the above-disclosed roof bolt 10. Using known casting and/or forging methods, the protrusion 34 will not break off when the resin or other binding agent is mixed.

The bores 26, 28 are generally tapered, sloping, or generally conical as discussed above, so as to interact with or correspond to the wedges in order to secure the appropriate ends of the cables the barrel 18. The tapered wedges are typically sloped or tapered on their outside surfaces (the surfaces away from the centerline of the appropriate bore) and typically include teeth or threads on their inside surfaces (the surfaces facing and abutting the cable). The internal surfaces, which are preferably hardened, are forced into engagement with the cable in a known manner in order to bite and grip the cable when the wedges are forced further into the tapered bores.

A twin cable mine twin cable roof bolt 10 assembled in accordance with the disclosed example may offer one or more functional advantages. For example, when the recess 34 and the nut 44 are sized as outlined above, only a standard 1⅛" square socket tool, which is readily available in underground mining operations, is required to spin the cable bolt 10 into the resin material. No extra tool is required to install the twin cable mine twin cable roof bolt 10. Also, the square pattern of the recess 34 is part of the wedge barrel casting, and thus the square recess cannot break off during spinning of the twin cable roof bolt 10. Moreover, due to the fact that the end 14 of the cable 12 is recessed within the wedge barrel 18 in or below the recess 34 and/or below the nut 44, the risk of injury may be reduced.

In accordance with the disclosed example, certain additional benefits may be realized. For example, the standard square drive socket (which is female) is the most commonly used wrench found in underground mining operations and hence no special tool is required in order to install the exemplary roof bolt 10.

It will be appreciated that any alternative details, embodiments or forms described in the foregoing are not intended to be mutually exclusive. Thus, various aspects and details of the disclosed example(s) may be interchanged with each other or used in conjunction with each other.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed:

1. A twin cable mine roof bolt comprising:

a barrel, the barrel having a first end, a generally dome-shaped second end, and an outer surface;

a pair of bores extending through the barrel between the first end and the second end, each of the bores including a generally conical portion narrowing toward the second end, each of the bores sized to receive a cable;

a pair of wedges sized for placement in the conical portion of each of the bores, each of the pair of wedges adapted to engage the cable in the corresponding bore with progressively greater force in response to movement of the wedges toward the second end; and a protrusion extending from the first end of the barrel, the protrusion sized for insertion into a socket wrench.

2. The twin cable mine roof bolt of claim 1, wherein the barrel includes a platform, the first and second bores extending at least to the platform, and wherein the protrusion is recessed in a radial direction from an outer edge of the platform.

3. The twin cable mine roof bolt of claim 1, including a pair of cables, each of the cables disposed in a corresponding one of the bores and secured in the corresponding bore by a corresponding pair of the wedges.

4. The twin cable mine roof bolt of claim 1, wherein the barrel defines a longitudinal axis, and wherein the bores are canted with respect to the longitudinal axis.

5. The twin cable mine roof bolt of claim 1, wherein the protrusion includes a pair of curved recesses.

6. The twin cable mine roof bolt of claim 1, wherein the protrusion includes a plurality of surfaces sized and shaped for engagement by the socket wrench.

7. The twin cable mine roof bolt of claim 6, wherein the protrusion includes a first end and a second end, a first pair of surfaces meeting at the first end and a second pair of surfaces meeting at the second end.

8. The twin cable mine roof bolt of claim 7, wherein at least one surface of the first pair of surfaces is parallel to at least one surface of the second pair of surfaces.

9. The twin cable mine roof bolt of claim 7, wherein the first pair of surfaces are generally perpendicular to each other, and wherein the second pair of surfaces are generally perpendicular to each other.

10. The twin cable mine roof bolt of claim 8, wherein a plane of the at least one surface of the first pair of surfaces is separated from the plane of the at least one surface of the second pair of surfaces a distance sized to match a size of the socket wrench.

11. The twin cable mine roof bolt of claim 1, wherein an outer surface of the barrel includes a pair of parallel flattened surfaces.

12. The twin cable mine roof bolt of claim 11, wherein each of the flattened surfaces includes a sloping outwardly extending flange.

13. The twin cable mine roof bolt of claim 12, wherein each flange slopes downwardly about 45°.

14. A twin cable mine roof bolt for use with a bearing plate and comprising:

a barrel, the barrel having a first end, a second end sized and shaped to engage the bearing plate, and an outer surface;

a pair of bores extending through the barrel between the first end and the second end, each of the bores including a generally conical portion narrowing toward the second end; each of the bores sized to receive a cable and pair of wedges; and a platform defined between the first end and the second end;

a protrusion extending from the platform, the protrusion recessed radially from the outer surface of the barrel, the protrusion sized for insertion into a socket wrench.

15. The twin cable mine roof bolt of claim 14, wherein the barrel includes a platform, the first and second bores extending at least to the platform, and wherein the protrusion is recessed in a radial direction from an outer edge of the platform.

16. The twin cable mine roof bolt of claim 15, including a cable and a pair of wedges sized for placement in the conical portion of each of the bores, each of the pair of wedges adapted to engage a corresponding one of the cables with progressively greater force in response to movement of the wedges toward the second end.

17. The twin cable mine roof bolt of claim 14, wherein the barrel defines a longitudinal axis, and wherein the bores are canted with respect to the longitudinal axis.

18. The twin cable mine roof bolt of claim 17, wherein the protrusion includes a pair of recesses.

19. The twin cable mine roof bolt of claim 15, wherein the protrusion includes a pair of spaced apart drive points, each of the drive points including at least one surface positioned for engagement by the socket wrench.

20. The twin cable mine roof bolt of claim 15, wherein an outer surface of the barrel includes a pair of parallel flattened surfaces, each of the flattened surfaces dispersed adjacent to a sloping flange.

21. The twin cable mine roof bolt of claim 15, the bearing plate having an aperture defining a seat, and wherein the second end of the barrel is shaped to mate with the seat.

22. The twin cable mine roof bolt of claim 14, wherein the barrel defines a longitudinal axis and the pair of bores are angled relative to the longitudinal axis, the pair of bores exiting the first end of the barrel on opposite sides of the protrusion.

23. The twin cable mine roof bolt of claim 22, wherein the second end of the barrel includes a curved surface, the pair of bores extending through the curved surface.

24. The twin cable mine roof bolt of claim 23, wherein the pair of bores include separate apertures in the curved surface.

25. A twin cable mine roof bolt comprising:

a barrel, the barrel defining a longitudinal axis and having a first end, a generally dome-shaped second end, and an outer surface;

a pair of bores extending through the barrel between the first end and the second end and angled in opposite directions relative to the longitudinal axis of the barrel, each of the bores including a generally conical portion narrowing toward the second end;

a pair of cables, each of the cables disposed in a corresponding one of the bores;

a pair of wedges sized for placement in the conical portion of each of the bores, each of the pair of wedges adapted to engage a corresponding one of the cables in a corresponding one of the bores with progressively greater force in response to movement of the wedges toward the second end;

a platform; and a protrusion extending from the platform, the protrusion including a plurality of driving surfaces set back relative to the outer surface of the barrel, the protrusion further including a pair of recessed positioned to accommodate the pair of bores, the protrusion sized for insertion into a socket wrench.

26. The twin cable mine roof bolt of claim 25, wherein the outer surface of the barrel includes a pair of opposed flattened surfaces, each of the flattened surfaces bounded by a sloping flange.

27. A method of installing a mine roof bolt comprising the steps of:

providing a barrel having a pair of tapered bores;

providing a cable disposed through each of the bores;

securing each of the cables in a corresponding one of the bores;

inserting the cables in a prepared hole;

applying a drive socket to a protrusion extending from the barrel; and rotating the barrel and the pair of cables about a longitudinal axis using the drive socket.

* * * * *

UNITED STATES PATENT AND TRADEMARK OFFICE

CERTIFICATE OF CORRECTION

PATENT NO. : 7,066,688 B2
APPLICATION NO. : 11/204703
DATED : June 27, 2006
INVENTOR(S) : Alexander I. Wallstein et al.

It is certified that error appears in the above-identified patent and that said Letters Patent is hereby corrected as shown below:

In the Claims:

At Column 6, line 26, “end; each” should be -- end, each --.

At Column 8, line 2, “recessed positioned” should be -- recesses positioned --.

Signed and Sealed this

Fifteenth Day of May, 2007

JON W. DUDAS
*Director of the United States Patent and Trademark Office*